United States Patent [19]

Sakuma

[11] 4,077,114

[45] Mar. 7, 1978

[54] VACUUM POWER INTERRUPTER

[75] Inventor: Shinzo Sakuma, Tokyo, Japan

[73] Assignees: Kabushiki Kaisha Meidensha; Kabushiki Kaisha Gemvac, both of Tokyo, Japan

[21] Appl. No.: 667,957

[22] Filed: Mar. 17, 1976

[30] Foreign Application Priority Data

| | | |
|---|---|---|
| Mar. 22, 1975 | Japan | 50-35168 |
| Mar. 22, 1975 | Japan | 50-35166 |

[51] Int. Cl.[2] ..... H01H 11/00

[52] U.S. Cl. ..... 29/622; 200/144 B; 228/122; 228/179; 228/221; 228/263

[58] Field of Search ..... 29/622; 228/179, 250, 228/122, 221, 263; 200/144 B

[56] References Cited

U.S. PATENT DOCUMENTS

| | | | |
|---|---|---|---|
| Re. 27,733 | 8/1973 | Bereza | 228/221 X |
| 3,355,564 | 11/1967 | Ranheim | 174/50.57 X |
| 3,430,015 | 2/1969 | Crouch et al. | 200/144 B |
| 3,566,463 | 3/1971 | Kobayashi et al. | 29/622 |
| 3,674,958 | 7/1972 | Attia et al. | 200/144 B |
| 3,857,005 | 12/1974 | Peche | 200/144 B |

*Primary Examiner*—Victor A. DiPalma
*Attorney, Agent, or Firm*—Haseltine, Lake & Waters

[57] ABSTRACT

This invention discloses a vacuum power interrupter, having high reliability of vacuum sealing, which is manufactured by using the most suitable brazing material whose main component is Cu or Au for each component of vacuum power interrupter in one brazing process or in two brazing processes.

2 Claims, 7 Drawing Figures

VACUUM POWER INTERRUPTER

BACKGROUND OF THE INVENTION

The present invention relates to a vacuum power interrupter and, more particularly, a vacuum power interrupter manufactured by using the most suitable vacuum hermetical brazing material as the material of each component.

Generally a, vacuum power interrupter such as vacuum circuit breaker is constructed by fixing an upper end plate and a lower end plate to both axial ends of a cylindrical insulating envelope respectively, mounting a bellows on the lower end plate, supporting a movable contact rod having a movable electrical contact at the top thereof to the bellows, and incorporating a stationary contact rod having a stationary electrical contact at the bottom thereof with the upper end plate.

In manufacturing the above mentioned vacuum power interrupter between, each component namely between the cylindrical insulating envelope and the upper end plate, between the bellows and the lower end plate, between the bellows and the movable contact rod, between the upper end plate and the stationary contact rod, between the stationary contact rod and the stationary electrical contact, between the movable contact rod and the movable electrical contact there is a suitable vacuum hermetical brazing material.

Various kinds of vacuum hermetical brazing materials are used according to the material of the components of the vacuum power interrupter. The results of applying various standard vacuum brazing materials (braze temperature range between 600° C and about 1000° C) to materials to be brazed are shown in Table 1 where mark "*o*" means proper, mark "*x*" means improper, m.p. is the melting point of the vacuum brazing material and f.p. is the flow point thereof.

It is well known from Table 1 that vacuum hermetical brazing materials of low melting point, such as indicated by No. 1 through No. 4 in Table 1, cannot be used in an alloy composed of iron and chromium (which will be called "Fe-Cr alloy" hereinafter) of high braze temperature range. And it is also well known from Table 1 that vacuum hermetical brazing materials of high melting point, such as indicated by No. 5 through No. 9 in Table 1, cannot be used in an alloy composed of silver (which will be called "Ag alloy" hereinafter) of low braze temperature range. It is therefore concluded that the braze temperature range strongly depends on the material of the bellows made of Fe-Cr alloy and the material of the electrical contacts made of an alloy composed of copper (which will be called "Cu alloy" hereinafter) or Ag alloy.

Table 1

| No. | vacuum brazing materials (Wt%) | m.p. (° C) | f.p. (° C) | materials to be brazed | | | | | | | | |
|---|---|---|---|---|---|---|---|---|---|---|---|---|
| | | | | Cu | Ni | Fe | Fe-Co alloy | Fe-Ni alloy | Fe-Cr alloy | F3-Ni-Co alloy | Cu alloy | Ag alloy |
| 1 | 61Ag-24Cu-15In | 630 | 705 | o | o | o | o | o | x | o | o | o |
| 2 | 60Ag-27Cu-13In | 605 | 710 | o | o | o | o | o | x | o | o | o |
| 3 | 72Ag-28Cu | 780 | 780 | o | o | o | o | o | x | o | o | o |
| 4 | 20Ag-60Au-20Cu | 835 | 845 | o | o | o | o | o | x | o | o | o |
| 5 | 80Au-20Cu | 890 | 890 | o | o | o | o | o | o | o | o | x |
| 6 | 53Cu-38Mn-9Ni | 880 | 910 | o | o | o | o | o | o | o | o | x |
| 7 | 82Au-18Ni | 950 | 950 | o | o | o | o | o | o | o | o | x |
| 8 | 100Ag | 960 | 960 | o | o | o | o | o | o | o | o | x |
| 9 | 85Ag-15Mn | 960 | 970 | o | o | o | o | o | o | o | o | x |

With respect to the vacuum braze temperature, generally heat from heat source is transmitted by radiation to a heated portion. Therefore, it is difficult to heat the heated portion in a short time. Moreover, it is necessary to add 50° C to the temperature of the flow point as the actual vacuum braze temperature due to the requirement for uniform heating of the heated portion.

The above examination therefore tells us, in the case of simultaneously brazing each component of a vacuum power interrupter, that the vacuum braze temperature must be set based on the lowest temperature of the material of the bellows, assuming that the material of the contact rods are made of Cu alloy. Accordingly, in this case the suitable vacuum hermetical brazing material can be that indicated by No. 5 through No. 9 in Table 1.

This establishes that, a vacuum power interrupter by simultaneously brazing each component, the material of the contact rod must be a Cu alloy having a wide braze temperature range and the vacuum braze temperature must to be set in accordance with the lowest temperature of the material of bellows made of Fe-Cr alloy of higher braze temperature than any other components. Moreover, in execution of the vacuum hermetical brazing, it is desirable to keep it completely hermetical for high reliability of the vacuum power interrupter.

An examination of the influences of the vacuum hermetical brazing material including Ag (which will be called "Ag brazing material" hereinafter) on Fe-Ni alloy shows that, if there is any melted Ag brazing material on the surface of the Fe-Ni alloy, percolation of the Ag brazing material into the grain boundary of the base material proceeds to a high degree and if there is any tension (external force or internal force, such as thermal stress which occurs when brazing metals of different coefficients of thermal expansion) applied to the base material, percolation of the Ag, brazing material into the grain boundary of the base material is apt to occur and such phenomena tends to generate cracks in the base material.

In order to investigate these causes, after brazing the base material without a plating or metal clad thereon, the presence of cracks in the base material based on percoration of the Ag brazing material into the grain boundary of the base material has been examined. The braze temperature is suitably set in accordance with the brazing material and the base material, and the base material is subjected to a tension stress between 1 Kg/mm and 12 Kg/mm. The result of this examination is shown in Table 2 where mark "*o*" indicating an unchanged condition, mark "*x*" indicates the presence of cracks and mark "Δ" indicates negligible presence of cracks. Brazing material including Cu will be called "Cu brazing material" and brazing material including Au will be called "Au brazing material" hereinafter and neither the Cu brazing material nor the Au brazing material includes Ag.

Table 2

| base material / brazing material | Fe-Ni-Co alloy | Fe | Fe-Ni alloy | Fe-Cr alloy | Cu |
|---|---|---|---|---|---|
| Ag brazing material | x | x | x | Δ | o |
| Cu brazing material | o | o | o | o | o |
| Au brazing material | o | o | o | o | o |

It is seen from Table 2 that cracks occur only when using Ag brazing material. If the value of the tension is changed within the above range the, same results have been obtained except that the time of the cracks changes respectively. According to circumstances, cracks which have occurred on the base material penetrate into the base material and consequently the base material is often cracked.

Next, in the case of the use of Ag brazing material as the base material with an Ni plating thereon the, occurrence of cracks on the base material under the same conditions as the above, the results are shown in Table 3 where mark "*o*" indicates an unchanged condition and mark "*x*" indicates the presence of cracks.

Table 3

| brazing condition | thickness of Ni plating | Fe-Ni-Co alloy | Fe | Fe-Ni alloy | Fe-Cr alloy |
|---|---|---|---|---|---|
| | 3 μ | x | x | x | o |
| in vacuum | 5 μ | x | x | x | o |
| | 8 μ | x | x | x | o |
| in hydrogen | 3 μ | o | o | o | o |

It is concluded that in vacuum hermetical brazing, it is inevitable to generate cracks on a base material made of Fe-Ni-Co alloy and Fe-Ni alloy in spite of an Ni plating thereon, whereas in the case of execution of hydrogen brazing, there are no cracks at all.

The cross sectional region of the brazed portion of the base material in the case of vacuum hermetical brazing and hydrogen brazing has been obserbed. In the case of the vacuum brazing material the, Ni plating layer is extricated from the surface of the base material by erosion of the brazing material and consequently the Ag brazing material percolates into the interstice formed by the erosion and directly contacts the base material. For this reason percoration into the grain bundary of the base material comes cracks. The same results are obtained, in the case of making the Ni plating layer thicker up to a value for example over 10 μ. This considerable thickness of the Ni plating layer on the base material results in damage to the plating tightness, increases the difference of thermal expansion, and increases the production time and costs of production. Therefore, the application of the Ni plating to base material in vacuum hermetical brazing is not favorable.

On the contrary, hydrogen brazing is free from the faults mentioned above because the Ni plating layer prevents the Ag brazing material from percolating into the base material. The difference between vacuum brazing and hydrogen brazing with respect to the influence of the Ag brazing material on the base materials mainly attributed to respective temperature conditions. Namely in hydrogen brazing, the heated portion is heated rapidly by conduction and radiation. For this reason, the heating time is short, for example within one minute and the blazing temperature can be set at the flow point or a little higher. Additionally due to a good cooling effect, the melting time of the brazing material is accordingly shortened, and substantial diffusion and percolation of the brazing material does not occur.

However, in vacuum brazing as the heated portion is heated only by radiation, it is difficult to heat this portion in a short time. Therefore, the brazing temperature in vacuum brazing is remarkably higher than that in hydrogen brazing and the cooling effect is considerably lowered. Therefore, the melting time of the brazing material is lengthened, for example, about half an hour, and diffusion and erosion of the brazing material into the base material is increased, and consequently cracks are apt to occur.

Further examination of the vacuum brazing material including Ag reveals the following; Namely examination on the causes of cracks in the base material in applying Ag brazing material to a base material made of Fe-Ni-Co alloy, Fe and Fe-Ni alloy will be made. In the case of melting an Ag brazing material on the surface of a base material, the Ag brazing material percolates into fine cracks or coarse portions of the base material and percolates into the wedge shaped grain boundary of the base material produced by such percolation and diffusion of the brazing material, and thereby cracks occur in the base material.

The above percolation and diffusion of the brazing material are promoted by the affinity and sensitivity between the base material and the Ag brazing material. If there is any tension applied to the base material, such percolation and diffusion as above mentioned will be further promoted.

On the contrary, Cu brazing material and Au brazing material which do not include Ag, disperse finely and uniformly percolate into the crystal grain boundary of the base material. A favorable diffusion layer for brazing is thus formed. Selective percolation into the grain boundary in the Ag brazing material is not observed. Even if a tension is applied to the base material, cracks do not occur. Cu brazing material and Au brazing material which do not include Ag, are applicable to a brazing material for brazing vacuum power interrupter which must have reliability of sealing. Of course, it is unnecessary to form an Ni plating on the base material.

Though hydrogen brazing has various advantages as above mentioned, some drawbacks in brazing are as follows;

*a.* It is necessary to evacuate at the predetermined degree of vacuum after hydrogen brazing. Therefore an additional manufacturing process, which is unnecessary in vacuum brazing, is required.

*b.* In hydrogen brazing work it is necessary to prevent any dangerous events from occurring.

*c.* A hydrogen brazing material which includes Mn, is improper as a vacuum brazing material as a result of the reaction between hydrogen and Mn.

A detailed analysis of the above reveals the following;

*a.* Ag brazing material is not suitable for brazing between end plates made of Fe-Ni alloy or Fe-Ni-Co alloy and cylindrical insulating envelope made of ceramics. On the contrary Cu brazing material is suitable for brazing such portion.

*b.* Cu brazing material or Au brazing material is suitable for brazing between the lower end plate and the bellows, and between the lower end plate and the arc-shield member.

*c.* Cu brazing material or Au brazing material is suitable for brazing between the bellows made of Fe-Cr alloy and a movable contact rod made of Cu.

*d.* Cu brazing material, Au brazing material or Ag brazing material is satisfactory for brazing between electrical contacts made of a Cu alloy and a contact made of Cu.

However, if the components of a vacuum interrupter are to be brazed simultaneously, brazing materials having overlapping ranges of braze temperature should be used and therefore a Cu brazing material or an Au brazing material is suitable in this case.

SUMMARY OF THE INVENTION

With the above in view, it is an object of the present invention to provide a vacuum power interrupter in which cracks in the upper end plate and the lower end plate are prevented by using the most suitable vacuum brazing material as the material of each component.

It is another object of the present invention to provide a vacuum power interrupter having high reliability of vacuum sealing and high mechanical strength.

It is still another object of the present invention to provide a vacuum power interrupter which is easy to work for brazing and whose production cost can be reduced.

It is still another object to provide a vacuum power interrupter in which it is unnecessary to provide an Ni plating on the material to be brazed.

It is a further object to provide a vacuum power interrupter which has high quality vacuum sealing in brazing each component upon one or two manufacturing steps.

It is still a further object to provide a vacuum power interrupter which is manufactured by using the most suitable vacuum brazing material for each component of the vacuum power interrupter.

In one aspect, the vacuum power interrupter according to the present invention is constructed by the steps of fixing an upper end plate and a lower end plate made of Fe-Ni alloy or Fe-Ni-Co alloy having substantially the same coefficient of thermal expansion to both ends of a cylindrical insulating envelope by a brazing material made of Cu alloy or Au alloy which does not include Ag, mounting a bellows made of Cu on the lower end plate by the brazing material, supporting a movable contact rod made of Cu at the upper end of the bellows, mounting a movable electrical contact on the upper end of the movable contact rod, inserting a stationary contact rod in the upper end plate through the brazing material, supporting a stationary electrical contact at the lower end of the stationary contact rod through the brazing material and brazing each component of the vacuum power interrupter in one manufacturing process.

In another aspect, the vacuum interrupter according the present invention is constructed by the steps of fixing an upper end plate and a lower end plate made of Fe-Ni-alloy or Fe-Ni-Co alloy having substantially the same coefficient of thermal expansion to both ends of a cylindrical insulating envelope by a first brazing material made of Cu alloy or Au alloy which does not include Ag, mounting a bellows made of Fe-Cr alloy on the upper end plate through the first brazing material, supporting a movable contact rod made of Cu an the upper end of the bellows through the first brazing material, then brazing each component of the vacuum power interrupter, next inserting a stationary electrical contact and a movable electrical contact made of Ag alloy or Cu alloy of braze temperature range between 600° C and 900° C, mounting this movable electrical contact on the upper end of the movable contact rod through a second brazing material whose melting point is lower than that of the first brazing material, inserting a stationary contact rod in the upper end plate, supporting the stationary electrical contact on the lower end of the stationary contact rod through the second brazing material and then brazing the remaining components of the vacuum power interrupter.

BRIEF DESCRIPTION OF THE DRAWING

Further features and advantages of the vacuum power interrupter according to the present invention will become more apparent from the following description taken in conjunction with the accompanying drawings in which.

DETAILED DESCRIPTION OF PREFERRED EMBODIMENT

Figure 1:
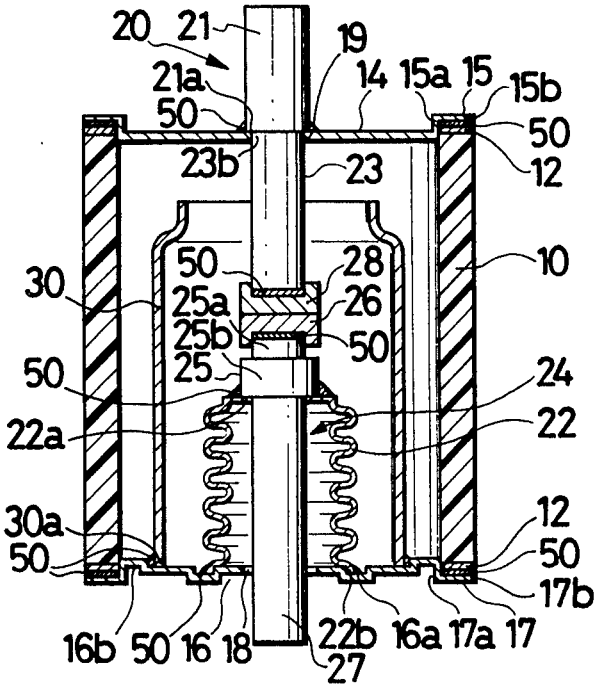
FIG. 1 is a longitudinal sectional view which schematically illustrates a preferred first embodiment of the vacuum power interrupter according to the present invention.
Figure 2:
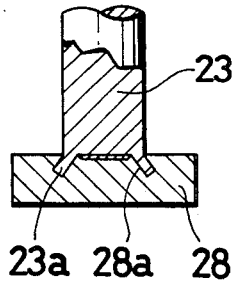
FIG. 2 is a longitudinal sectional partial view which schematically illustrates a stationary electrical contact carried by a stationary contact rod as shown in FIG. 1 according to the present invention.

As shown in FIG. 1, the vacuum power interrupter includes a vacuum bulb which is composed of a cylindrical insulating envelope 10 and a pair of disc shaped upper and lower end plates 14 and 16 to which the insulating envelope 10 is securely and hermetically connected at its axial ends, respectively, which form part of the insulating envelope 10. Metallized portion 12 composed of a metal suitable for vacuum hermetical brazing is formed at both axial ends of the insulating envelope 10. A securing portion 15 formed along the periphery of the disc shaped upper end plate 14 comprises a portion 15*a* bent normally to the surface of the upper end plate and a horizontal bent portions 15*b*. Brazing material 50 which includes Cu alloy or Au alloy and does not include Ag alloy is inserted between the securing portion 15 and the metallized portion 12 formed at the upper end of the insulating envelope 10. A securing portion 17 formed along the periphery of the disc shaped lower end plate 16 comprises a portion 17*a* bent normally to the surface of the lower end plate 16 and a horizontal bent portion 17*b*. The brazing material 50 is inserted between the securing portion 17 and the metallized portion 12 formed at the lower end of the insulating envelope 10. The upper end plate 14 of the vacuum bulb is formed with a central aperture 19 through which a stationary contact rod 20 axially projects into the vacuum bulb which rod carries at its lower end a stationary electrical contact 28 through the vacuum brazing material 50. The stationary contact rod 20 comprises a upper column portion 21 and a lower column portion 23 whose diameter is smaller than that of the upper column portion 21. The brazing material 50 is present in the central aperture 19 of the upper end plate 14, at the bottom of upper column portion 21 and at the upper end of the lower column portion 23. Referring to the relation between stationary contact rod 20 and stationary electrical contact 28, as shown in FIG. 2 the lower end of the lower column portion 23 is formed with a pair of projections 23*a* projecting downwardly in a slanting direction and the upper surface of the stationary electrical contact 28 is formed with an annular groove 28*a* for receiving the projection 23*a* through the brazing material 50. The shape of the projections 23*a* is not limited to the embodiment stated above, and namely a plural set of projections as well as one pair and a skirt shaped projection will be satisfactory. The lower end plate 16 of the vacuum bulb is formed with a central aperture 18 through which a movable contact rod 24 axially projects into the vacuum bulb. The movable contact rod 24 extends in line with the stationary contact rod 20 and carries at its upper end a movable electrical contact 26. The movable contact rod 24 comprises an upper column portion 25 which is composed of a first column portion 25*a* and a second column portion 25*b* whose diameter is larger than that of the first column portion, and a lower column portion 27. The movable electrical contact 26 is mounted on the first column portion 25*a* of the upper column portion 25 through the vacuum brazing material. The movable contact rod 24 is electrically connected to a leading-out line of the vacuum power interrupter and is mechanically connected to an actuating member of a control mechanism which is usually located below the interrupter unit, not shown. The movable contact rod 24 is thus driven by the control mechanism to axially move toward and away from the stationary contact rod 20 so that an electrical connection is established or interrupted between movable electrical contact 26 and stationary electrical contact 28 on the stationary and movable contact rods 24 and 20, respectively. The central aperture 18 in the lower end plate 16 of the vacuum bulb is sealed off by means of a metallic bellows 22 which is connected between the lower end plate 16 and the movable contact rod 24. The lower end portion 22*b* of the bellows 22 is fixed in a recess 16*a* formed in the lower end plate 16 through vacuum brazing material 50. The upper end portion 22*a* of the bellows 22 is fixed to the top of the lower column portion 27 of movable contact rod 24 through vacuum brazing material 50. A cup shaped arc-shield member 30 is mounted on the lower end plate 16 for preventing influences based on arc plasma produced between the movable electrical contact 26 and stationary electrical contact 28 when the movable contact rod 24 is moved away from the stationary contact rod 20. The lower end portion 30*a* of the arc-shield member 30 is fixed to bent portion 16*b* through the vacuum brazing material 50.

Figure 7:
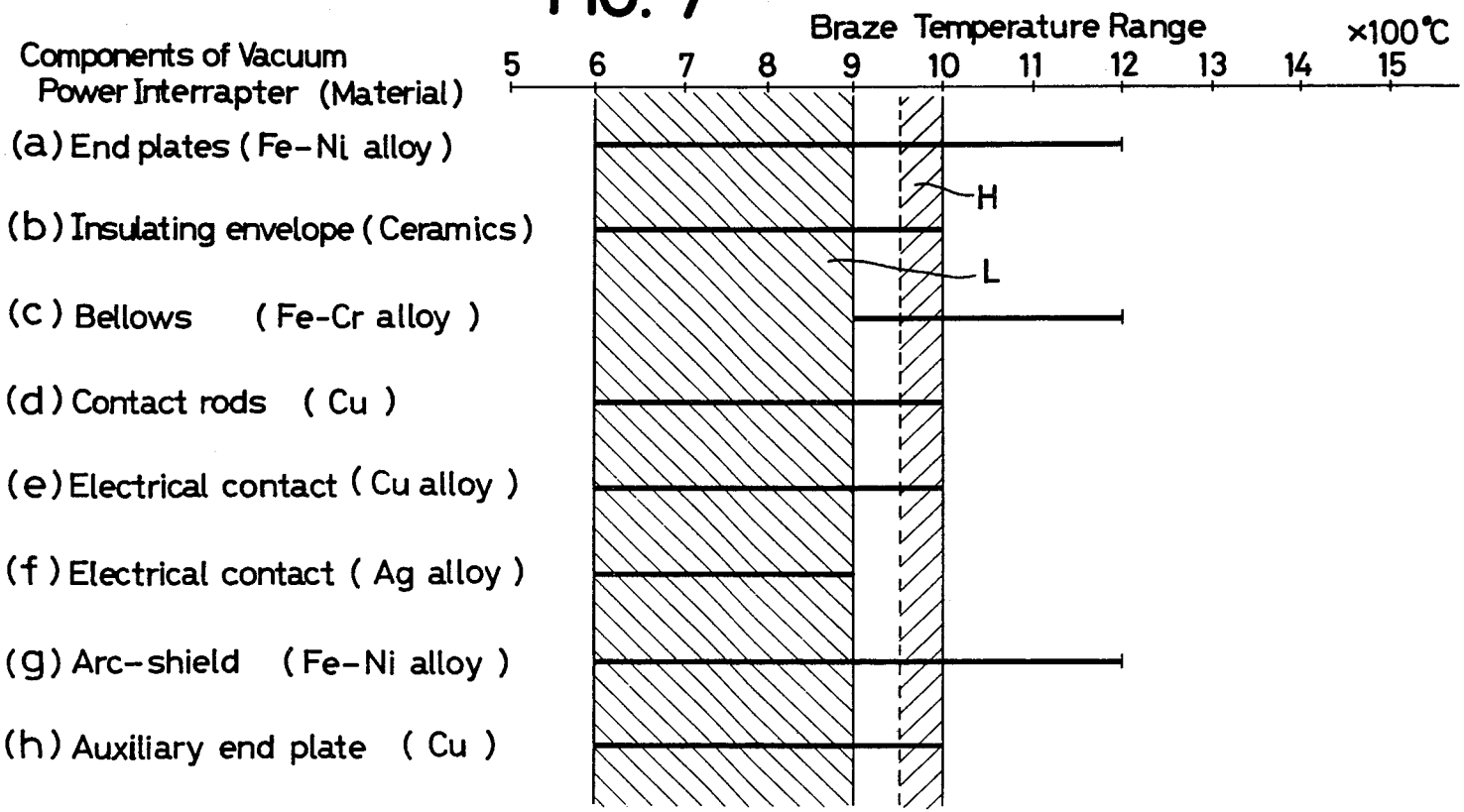
FIG. 7 is diagrammatical view which illustrates the characteristic of the braze temperature range of each component of vacuum power interrupter according to the present invention.

Referring now to the material of each component of vacuum power interrupter, the insulating envelope 10 is made of a ceramic, whose main component is $Al_2O_3$ and the remaining component is a glass material such as MnO, Mgo, $SiO_2$, having a braze temperature range between 600° C and about 1000°0 C as shown in FIG. 7 (*b*). Metallized portion 12 formed at the axial ends of the insulating envelope 10 is made of a metal alloy obtained by adding Mo or Mn to appendix material such as Ti. The upper end plate 14 and lower end plate 16 are mde of Fe-Ni alloy or Fe-Ni-Co alloy whose coefficient of thermal expansion is substantially the same as that of the insulating envelope 10 (namely, the coefficient of thermal expansion of the Fe-Ni alloy or Fe-Ni-Co alloy is $12.5 \times 10^{-6}/°$ C and that of ceramic is $8.6 \times 10^{-6}/°$ C) and the braze temperature is between 600° C and about 1200° C as shown in FIG. 7 (*a*). The stationary contact rod 20 and the movable contact rod 24 are made of Cu having a braze temperature between 600° C and about 1000° C as shown in FIG. 7 (*a*). The arc-shield member 30 is made of any of Fe, Ni, Fe-Ni alloy, Fe-Cr alloy, Cu and ceramic, and one example of an Fe-Ni alloy whose braze vacuum temperature is between 600° C and about 1200° C as the material of the arc-shield member 30 is illustrated in FIG. 7 (*g*). Bellows 22 is made of Fe-Cr alloy whose braze vacuum temperature is betwen 900° C and about 1200° C as shown in FIG. 7 (*c*). The stationary electrical contact 28 and the movable electrical contact 26 are made of Cu alloy whose braze vacuum temperature is between 600° C and about 1000° C as shown in FIG. 7 (*e*).

With respect to choosing the selection of the most suitable vacuum brazing material, for the manufacture by one step brazing of each component of the vacuum power interrupter, vacuum brazing materials which include material having a high melting point such as Cu alloy or Au alloy excluding Ag alloy is suitable for brazing. In the choice of this vacuum brazing material, it is well known from Table 1 that the brazing materials indicated by reference numerals No. 5 through No. 9 is good for brazing in accordance with braze temperature condition. However, in the case of using vacuum brazing material including Ag, for example, indicated by reference numeral No. 8 and No. 9, the production of cracks in the material to be brazed is inevitable. Therefore, the applicable vacuum brazing material is limited to those which include Cu alloy or Au alloy excluding Ag, for example the materials indicated by reference numerals No. 5 through No. 7, namely 80Au-20Cu, 53Cu-38-Mn-9Ni and 82Au-18Ni. With the above in view, the suitable brazing material is more generally preferable to an alloy which comprises Cu, Au Mn, and Ni.

From the point of view of the braze temperature range, in order to braze each component one time, the braze temperature range of each component must overlap. In other words, it is necessary that a suitable braze temperature range be between 900° C and about 1000° C. It is preferable that the actual braze temperature range be between 950° C and 1000° C, which is designated by reference mark "H" as shown in FIG. 7.

Figure 3:
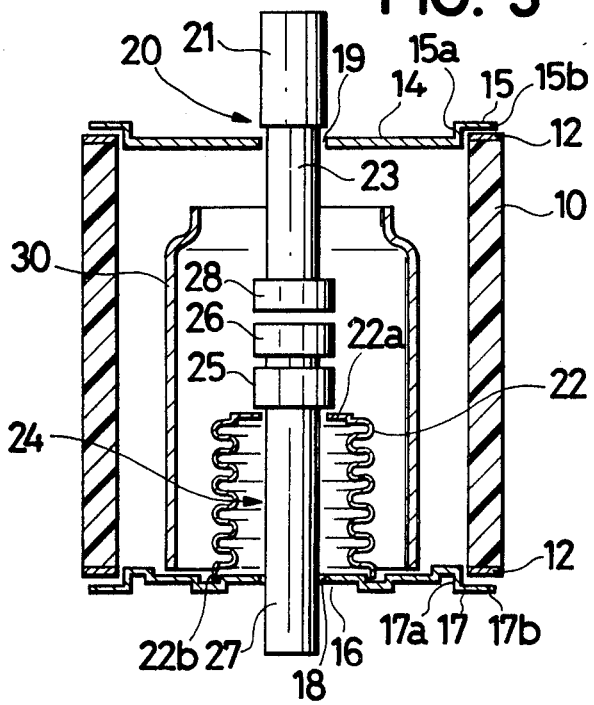
FIG. 3 is an explanatory view which schematically illustrates the provisional assembly of each component of the vacuum power interrupter as shown in FIG. 1 according to the present invention.

The method of manufacturing the vacuum power interrupter according to the first embodiment of the present invention will now be taken in conjunction with FIGS. 1-3. For convenience of explanation, the vacuum brazing material 50 is not shown in FIG. 3.

Referring to FIG. 3, the components of the interrupter are assembled by the steps of disposing the end plates 14 and 16 at the axial ends of the insulating envelope 10 through the brazing material 50, mounting bellows 22 on the central portion of the lower end plate 16 through the brazing material 50, supporting the movable contact rod 24 at the upper end of the bellows 22 through the brazing material 50, mounting the movable electrical contact 26 on the upper end of the movable contact rod 24 through the brazing material 50, inserting the stationary contact rod 20 in the aperture 19 of the upper end plate 14 through the vacuum brazing material 50, carrying the stationary electrical contact 28 at the lower end of the stationary contact rod 20 through the brazing material 50, and disposing the arc-shield member 30 on the lower end plate 16 through the brazing material 50. The following steps are further carried out which include; heating the brazing material 50 which is inserted in the assembling components provisionally assembled as above at a braze temperature which is between 950° C and 1000° C while evacuating at a pressure which is less than $10^{-5}$ to $10^{-6}$ Torr, and letting gases induced by heating each component out of the vacuum power interrupter. When the brazing material for each component is melted, the respective components of the vacuum power interrupter are securely and hermetically fixed to each other.

From the foregoing description, it will now be appreciated that the following advantages can be achieved in a vacuum power interrupter according to the present invention by virtue of using the most suitable vacuum brazing material for the material of the components of the vacuum power interrupter.

*a.* Because of suitably choosing the material of each component of the vacuum power interrupter and using vacuum brazing material 50 which includes Cu alloy or Au alloy excluding Ag alloy, the end plates 14 and 16 are prevented from producing cracks and thereby high reliability of vacuum sealing is obtained.

*b.* Because of using the vacuum brazing material 50 excluding Ag, the vacuum power interrupter has high mechanical strength to tension applied to each component.

*c.* Because of the unnecessity of forming an Ni plating on the material to be brazed, the time of brazing can be significantly lessened and the production cost can be reduced.

*d.* Because of the fact that each component of the vacuum power interrupter is provisionally assembled inserting brazing material between each component and then the vacuum brazing operation is carried out in one step, the time of brazing can be further significantly lessened and a vacuum power interrupter having high reliability for vacuum sealing can be easily obtained.

The evacuation which is necessary in the case of hydrogen brazing is not necessary and thereby the time for brazing is further saved. The brazing according to the present invention is free from other defects which occur in the case of hydrogen brazing as mentioned above.

*e.* Because of the fact that the coefficient of thermal expansion of the material of the insulating envelope 10 is substantially the same as that of the end plates 14 and 16, good vacuum hermetical brazing is carried out and the insulating envelope 10 is not ruptured by shearing stress which is produced when materials of different coefficient of thermal expansion are cooled and contracted.

*f.* Because of the fact that the securing portions 15 and 17 formed on the periphery of the end plates 14 and 16 are formed as bent portions the stress which is produced in the central portion of the end plates by the different extension, upon heating, between the flat portion and the peripheral securing portions is avoided and thereby high reliability of sealing can be obtained.

*g.* Because of the fact that a pair of projections 23*a* are formed at the bottom of the stationary contact rod 20 and fitted into annular gloove 28*a* formed in the stationary electrical contact 28, the stationary electrical contact 28 will not fall downwardly if each component is provisionally assembled.

Next will be given a description of the second embodiment according to the present invention. An outline of the second embodiment is similar to that of first embodiment stated above, but it is a main feature in the second embodiment that vacuum brazing is executed in two steps. In FIGS. 4-7, the same reference numerals are used as in FIGS. 1-3 to indicate corresponding parts of the vacuum power interrupter and therefore detailed description of the corresponding parts described above will be omitted.

Figure 4:
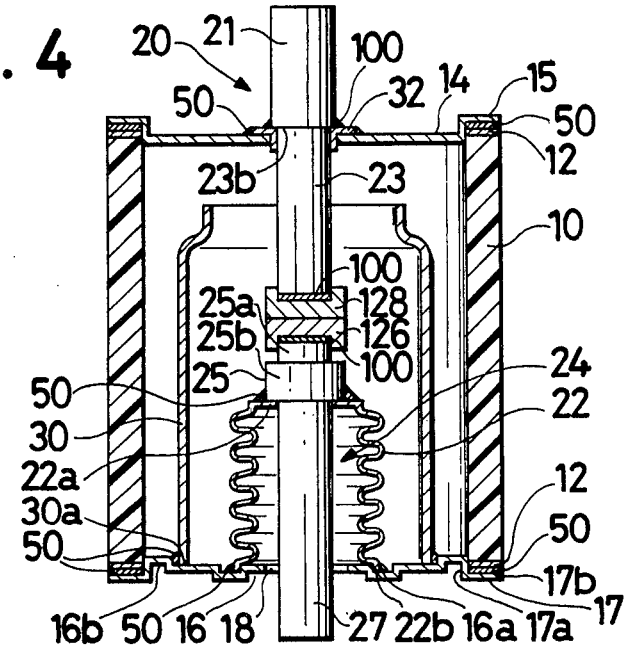
FIG. 4 is a longitudinal sectional view which schematically illustrates a preferred second embodiment of the vacuum power interrupter according to present invention.
Figure 5:
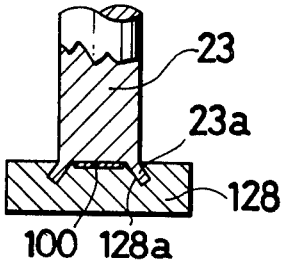
FIG. 5 is a longitudinal sectional partial view which schematically illustrates a stationary electrical contact supported by a stationary contact rod as shown in FIG. 4 according to the present invention.

As shown in FIG. 4, an auxiliary end plate 32 having a central bore therein is fixed to the central aperture 19 formed in the upper end plate 14 through the first brazing material 50 (corresponding to the brazing material as stated in the first embodiment). The stationary contact rod 20 is inserted in the auxiliary end plate 32 through a second brazing material 100. The stationary electrical contact 128 is carried at the bottom of the stationary contact rod 20 through the second brazing material 100. Referring to the relation between stationary contact rod 20 and stationary electrical contact 128, as shown in FIG. 5, the upper surface of the stationary electrical contact 128 is formed with an annular groove 128*a* receiving projections 23*a* of the stationary contact rod 20 through the second brazing material 100. The movable electrical contact 126 is mounted on the first column portion 25*a* of the movable contact rod 24 through the second brazing material 100.

Referring now to the material of the components of the second embodiment according to the present invnetion, the auxiliary end plate 32 is made of Cu which does not generate cracks by Ag brazing material and has a wide braze temperature range as shown in FIG. 7 (*h*). The movable electrical contact 128 and the stationary electrical contact 126 are made of Ag alloy whose braze temperature range is between 600° C and about 900° C as shown in FIG. 7 (*f*) or Cu alloy whose braze temperature range is between 600° C and about 900° C. Other components of the vacuum power interrupter are made of the same materials as stated in the first embodiment, respectively.

Since electrical contacts 126 and 128 are made of Ag alloy or Cu alloy whose braze temperature range is between 600° C and about 900° C, it is impossible to braze all the elements of the vacuum power interrupter at one time. Therefore, it is necessary that as a first step, each component is brazed except for the stationary contact rod 20, the stationary electrical contact 128 and the movable electrical contact 126 through the first brazing material 50, and as a second step the remaining components are brazed namely between auxiliary end plate 32 and the stationary contact rod 20, between the stationary contact rod 20 and the stationary electrical contact 128 and between the movable electrical contact 126 and the movable contact rod 24 through the second brazing material 100.

With the above in view, the first brazing material 50 is preferably the same as the above stated brazing material, whose braze temperature is between 950° C and 1000° C, which is designated by reference mark "H" as shown in FIG. 7 and the second brazing material 100 is Ag alloy or Cu alloy whose braze temperature range is between 600° C and 900° C, which is designated by reference mark "L" as shown in FIG. 7.

Figure 6:
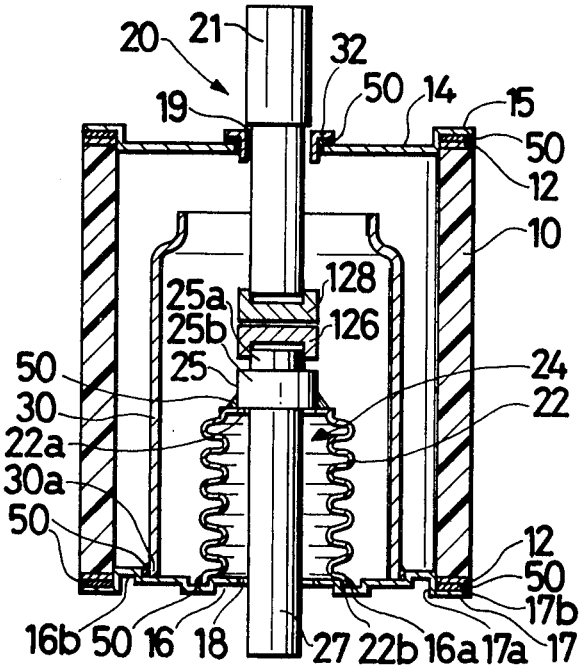
FIG. 6 is an explanatory view which schematically illustrates the provisional assembly for second brazing of the remaining components after execution of a first brazing of components as shown in FIG. 4 according to the present invention.

The method of manufacturing the vacuum power interrupter according to the second embodiment of the present invention is now described in conjunction with FIGS. 4–6. For convenience of explanation, the second brazing material 100 is not shown in FIG. 6. The vacuum power interrupter which comprises first and second groups of assembling components which are constructed by the step of disposing the end plates 14 and 16 at the axial ends of the insulating envelope 10 through the first brazing material 50, mounting bellows 22 on the central portion of the lower end plate 16 through the first brazing material 50, mounting bellows 22 and arc-shield member 30 on the central portion of the lower portion through the first brazing material, supporting the movable contact rod 24 at the upper end of the bellows 22 through the first brazing material, and fixing the auxiliary end plate 32 to the central aperture 19 formed in the upper end plate 14 through the first brazing material 50. When each component of the vacuum power interrupter is provisionally assembled, a clearance suitable for inserting the second brazing material 100 is formed between the stationary contact rod 20 and the auxiliary end plate 32 surrounding the stationary contact rod 20.

The following steps are further carried out which include;

heating the first brazing material 50 which is inserted in the first group of assembling components provisionally assembled as above, at a braze temperature which is between 950° C and about 1000° C while evacuating at the pressure which is less than $10^{-5}$ to $10^{-6}$ Torr., and letting the gases produced by the heating of each component escape from the vacuum power interrupter.

The reason why the bellows 22 made of Fe-Cr alloy must be brazed in the first brazing process is that, because the braze temperature range of bellows 22 does not overlap that of the electrical contacts 126 and 128 made of Ag alloy or Cu alloy whose braze temperature range is between 600° C and 900° C, it is impossible to simultaneously braze bellows 22 and the electrical contacts 126 and 128 as seen from FIG. 7. The reason why end plates 14 and 16 made of Fe-Ni alloy or Fe-Ni-Co must be brazed in a first brazing process is because it is necessary to use the brazing material, having a low melting point, which includes Ag in a second brazing process, cracks are apt to occur on the end plates 14 and 16 by the influence of Ag included in the above brazing material. The reason why the auxiliary end plate 32 must be fixed to the central aperture 19 of the upper end plate 14 by the first brazing process is that, if the stationary contact rod 20 is directly simultaneously fitted to the upper end plate 14 in the first brazing process, it is impossible to insert electrical contacts in the insulating envelope 10 in the second brazing process and it is inevitable to generate cracks between the upper end plate 14 and the stationary contact rod 20 at a second brazing process.

The following steps are still further carried out which include;

inserting the electrical contacts 126 and 128 made of Ag alloy or Cu alloy whose braze temperature range is between 600° C and 900° C in the insulating envelope 10 through the auxiliary end plate 32, mounting the movable electrical contacts 126 on the movable contact rod 24 through the second brazing material 100 whose melting point is lower than that of the first brazing material 50 and whose braze temperature range is between 600° C and 900° C, supporting the stationary contact rod 20 at the auxiliary end plate 32 through the second brazing material 100, and carrying the stationary electrical contact 128 at the lower end of the stationary contact rod 20 through the second brazing material 100.

The following steps are carried out which include;

heating the second brazing material 100 which is inserted in the second group of assembling components provisionally assembled as above, at the braze temperature which is between 600° C and 900° C while evacuating at the pressure which is less than $10^{-5}$ to $10^{-6}$Torr., and letting gases induced by heating each component out of the vacuum power interrupter.

From the foregoing description, it will now be appreciated that the following advantages as well as the advantages stated in the first embodiment of the present invention can be achieved in the vacuum power interrupter according to the present invention:

*a.* Because of the fact that first brazing of the bellows 22 made of Fe-Cr alloy whose braze temperature range is between 900° C and 1200° C and end plates 14 and 16 made of Fe-Ni alloy or Fe-Ni-Co alloy no cracks occur therein due to Ag brazing material, and then second brazing of the electrical contacts 126 and 128 made of Ag alloy or Cu alloy whose braze temperature range is between 600° C and 900° C is carried out, cracks do not occur in the end plates 14 and 16 and high reliability for vacuum hermetical brazing can be easily obtained.

*b.* Because of the fact that two kinds of brazing materials which are made of different materials are suitably used in accordance with first and second brazing operating respectively, even if it is necessary to use electrical contacts made of Ag alloy or Cu alloy whose braze temperature range is between 600° C and 900° C, a vacuum power interrupter having high reliability for sealing is easily manufactured.

What is claimed is:

1. A method of making a vacuum power interrupter comprises the steps of (a) disposing a disc shaped upper end plate having an aperture in the center thereof and a disc shaped lower end plate on the ends of an insulating envelope, said plates being made of Fe-Ni alloy or Fe-Ni-Co alloy and having substantially the same coefficient of thermal expansion as the cylindrical insulating envelope, said envelope being made of a ceramic, interposing a brazing material which is Cu alloy or Au alloy excluding Ag between the plates and the envelope, (b) mounting a bellows made of Fe-Cr alloy on a central portion of said lower end plate through said brazing material, (c) supporting a movable contact rod, which is made of Cu, at the upper end of said bellows through said brazing material, (d) mounting a movable electrical contact, which is made of Cu alloy on the upper end of said movable contact rod through said brazing material, (e) inserting a stationary contact rod, which is made of Cu, in the aperture of said upper end plate through said brazing material, (f) carrying a stationary electrical contact, which is made of Cu, at the lower end of said contact rod, through said brazing material, (g) heating said brazing material at a braze temperature range which is between 950° and about 1000° while evacuating at a pressure which is less than $10^{-5}$Torr. to $10^{-6}$Torr. to melt said brazing material, thereby combining securely and hermetically said assembling components.

2. A method of making a vacuum power interrupter having a first and a second groups of assembling components by the steps comprising:

(a) disposing a disc shaped upper end plate having an aperture in the center thereof and a disc shaped lower end plate on the axial ends of a cylindrical insulating envelope, said plates being made of Fe-Ni alloy or Fe-Ni-Co alloy and have substantially the same coefficient of thermal expansion as the cylindrical insulating envelope, said envelope being made of a ceramic, a first brazing material which includes Cu alloy or Au alloy excluding Ag being interposed between the plates and the envelope, (b) mounting a bellows, which is made of Fe-Cr alloy on a central portion of said lower end plate through said first brazing material, (c) supporting a movable contact rod, which is made of Cu, at the upper end of said bellows through said first brazing material, (d) inserting an auxiliary end plate, which is made of Cu, in the aperture of said upper end plate through said first brazing material, (e) heating said first brazing material which is inserted in the first group of assembling components therebetween at a braze temperature range which is between 950° C and about 1000° C while evacuating at a pressure which is less than $10^{-5}$Torr. to $10^{-6}$Torr. to melt said first brazing material, (f) thereby combining securely said first group of assembling components, (g) then inserting a stationary electrical contact and a movable electrical contact, which are made of Ag alloy or Cu alloy whose braze temperature range is between 600° C and about 900° C in said insulating envelope, (h) mounting said movable electrical contact on the upper end of said movable contact rod through a second brazing material whose braze temperature range is between 600° C and about 900° C, (i) inserting said auxiliary end plate in the aperture of said upper end plate through said brazing material, (j) carrying said stationary electrical contact at the lower end of said stationary contact rod through said second brazing material, (k) heating said second brazing material which is inserted in the second group of assembling components therebetween at a braze temperature range which is between 600° C and about 900° C while evacuating at a pressure which is less than $10^{-5}$Torr. to $10^{-6}$Torr. to melt said second brazing material, thereby combining securely and hermetically said second assembling components.

* * * * *